United States Patent [19]

Zilch

[11] Patent Number: 4,820,438

[45] Date of Patent: Apr. 11, 1989

[54] NOVEL SOAP BAR COMPOSITION

[75] Inventor: Karl T. Zilch, Cincinnati, Ohio

[73] Assignee: Quantum Chemical Corporation, Cincinnati, Ohio

[21] Appl. No.: 149,722

[22] Filed: Jan. 29, 1988

[51] Int. Cl.[4] ..... C11D 9/00; C11D 15/00; C11D 13/00

[52] U.S. Cl. ..... 252/108; 252/117; 252/367; 252/368; 252/369; 252/370; 252/DIG. 16

[58] Field of Search ..... 252/108, 117, 367, 368, 252/369, 370, DIG. 16

[56] References Cited

U.S. PATENT DOCUMENTS

| | | | |
|---|---|---|---|
| 2,649,417 | 8/1953 | Compa | 252/367 |
| 2,792,347 | 5/1957 | Stegemeyer | 252/368 |
| 3,576,749 | 4/1971 | Megson et al. | 252/108 |
| 3,793,214 | 2/1974 | O'Neill et al. | 252/117 |
| 4,584,126 | 4/1986 | Joshi | 252/368 |

*Primary Examiner*—Paul Lieberman
*Assistant Examiner*—Ronald A. Krasnow
*Attorney, Agent, or Firm*—Wood, Herron & Evans

[57] ABSTRACT

Soap bars having improved lathering properties of flash foam, lather volume and lather richness are prepared by stripping natural short chain saturated fatty acids in the ranges of $C_6$ to $C_{10}$ and replacing with approximately the same weight percentage of pelargonic acid.

9 Claims, No Drawings

NOVEL SOAP BAR COMPOSITION

FIELD OF THE INVENTION

This invention relates to a novel fatty acid composition which when neutralized produces a soap bar having improved lathering properties.

BACKGROUND OF THE INVENTION

Soap bars for cleaning use are typically prepared by neutralizing fatty acids with an aqueous solution of a base such as sodium hydroxide, potassium hydroxide, or an alkanolamine. The fatty acids are typically derived from natural sources, such as beef tallow, mutton tallow, palm oil, olive oil, palm kernel oil, and coconut oil, among others. These natural sources contain fatty acid components which are predominantly of even chain length due to the biochemical synthesis mechanism of living organisms.

Commercial soap bars are produced from blends of naturally derived fatty acids chosen to optimize specific performance characteristics. A soap formed from lower molecular weight saturated fatty acids in the range of about 8 to 12 carbon atoms produces a bar which rapidly generates large quantities of bubbles which quickly break on continued lathering. Higher molecular weight saturated fatty acids in the 14 to 18 carbon range produce soap bars which slowly generate a dense, creamy, stable foam on lathering. A bar produced from predominantly short chain fatty acid soaps has a relatively short lifetime because the soap dissolves rapidly in water. Conversely, long chain saturated fatty acid soaps are relatively less soluble and a bar produced therefrom has a longer lifetime. Unsaturated fatty acid soaps such as are produced from oleic acid are more soluble than the saturated long chain soaps and also tend to develop lather faster. However, the foam generated is dense and creamy, and is thus similar in this respect to the long chain saturated soaps.

To obtain a balance of the properties of fast foam generation (flash foam), good foam volume, rich and creamy lather, and acceptable bar lifetime, commercial soap manufacturers typically employ a fatty acid blend comprised of about 80% tallow fatty acid and about 20% coconut-type fatty acid. Specifications for a typical tallow fatty acid and coconut-type fatty acid are listed in the table below.

TABLE 1

TYPICAL COMPOSITION BY CHAIN LENGTH

| Chain Length | Tallow Fatty Acid | Coconut-Type Fatty Acid |
|---|---|---|
| $C_8$ | — | 7.0 |
| $C_9$ | — | — |
| $C_{10}$ | — | 6.0 |
| $C_{12}$ | — | 51.0 |
| $C_{14}$ | 2.5 | 18.0 |
| $C_{15}$ | 0.5 | — |
| $C_{16}$ | 27.0 | 10.0 |
| $C_{16:1}$ | 4.0 | — |
| $C_{17}$ | 1.0 | — |
| $C_{18}$ | 17.0 | 7.0 |
| $C_{18:1}$ | 42.0 | 1.0 |
| $C_{18:2}$ | 5.0 | — |
| $C_{18:2}$ | 5.0 | — |
| $C_{18:3}$ | 1.0 | — |

Typically, a formulator attempting to improve one property of a bar will have to sacrifice a portion of the performance of another property. Without incorporation of specific soap additives to alter bar properties, a shifting of the component fatty acid composition to a higher long chain saturated acid content will produce a bar with improved lather richness but will result in a loss of a portion of the flash foam and foam volume properties. Shifting the composition to a higher short chain saturated acid content will produce a bar having improved flash foam but with diminished lather richness and a decreased lifetime of the bar.

BRIEF DESCRIPTION OF THE INVENTION

It is an object of this invention to produce a soap bar having improved lather characteristics in relation to a standard 80:20 tallow/coco soap bar without significantly altering the relative amounts of short chain and long chain fatty acids in the soap bar composition.

Pursuant to this object it has been found that the fraction of saturated fatty acids having a chain length of 6 to 10 carbon atoms can be removed, or stripped, from a coconut-type fatty acid, and be replaced by about an equal weight amount of pelargonic acid. Pelargonic acid is an odd chain length ($C_9$) liquid saturated monobasic acid produced by Quantum Chemical Corporation, Emery Division, via the ozonolysis of oleic acid, and sold as Emery® 1202 Pelargonic Acid.

Removal of the $C_6$ to $C_{10}$ fatty acid fraction and replacement with $C_9$ fatty acid unexpectedly improves the lathering characteristics of a bar based primarily on tallow and coco fatty acids without altering the relative chain length proportion of the fatty acid blend.

DETAILED DESCRIPTION OF THE INVENTION

In its broad aspects the invention relates to a novel soap bar composition comprising a blend of about 68% to about 84% by weight tallow fatty acid, about 28% to about 14% by weight coconut-type fatty acid, and about 2% to about 5% by weight pelargonic acid, wherein the blend is neutralized by an aqueous solution of a base such as sodium hydroxide, potassium hydroxide, triethanolamine and mixtures thereof. The water content of the soap composition varies in the range of about 5% to about 30% by weight. Preferably, the fatty acid blend for the soap bar composition is comprised of about 78% to about 83% by weight tallow fatty acid, about 20% to about 15% by weight coconut-type fatty acid, and about 2% to about 4% by weight pelargonic acid.

This composition is preferably formed into a soap bar by subjecting the neutralized soap to the finishing steps of refining, plodding and stamping, such operations being well-known to those skilled in the art. Though not preferred, this composition may also be employed to produce a framed/cast soap, a procedure which is also well-known in the art.

The fatty acid blend for producing the novel soap composition is prepared by removing, or stripping, the short chain length component fatty acids from a coconut-type fatty acid, usually by distillation. The term coconut-type fatty acid is employed to encompass the complete fatty acid mixture obtained from any of a number of natural vegetable oils which have a relatively large proportion of a $C_{12}$ fatty acid as a component therein. Several vegetable oils of this type with their typical fatty acid compositions are listed in Table 2 below.

TABLE 2

| VEGETABLE OIL COMPOSITION* | | | |
|---|---|---|---|
| Fatty Acid | Oil | | |
| Component | Babassu | Coconut | Palm Kernel |
| $C_8$ | 3.5 | 7.6 | 1.4 |
| $C_{10}$ | 4.5 | 7.3 | 2.9 |
| $C_{12}$ | 44.7 | 48.2 | 50.9 |
| $C_{14}$ | 17.5 | 16.6 | 18.4 |
| $C_{16}$ | 9.7 | 8.0 | 8.7 |
| $C_{16:1}$ | — | 1.0 | — |
| $C_{18}$ | 3.1 | 3.8 | 1.9 |
| $C_{18:1}$ | 15.2 | 5.0 | 14.6 |
| $C_{18:2}$ | 1.8 | 2.5 | 1.2 |

*Source: Natural Fats and Oils Composition Table, Ashland Chemical Company, Copyright 1969

An amount of pelargonic acid approximately equal in weight to the component short chain fatty acids stripped from the coconut-type fatty acid is then measured. The stripped coconut-type fatty acid and the measured amount of pelargonic acid are then combined with tallow fatty acid in a homogeneous fashion to form the desired fatty acid blend.

Neutralization of the desired fatty acid blend is accomplished by reacting the blend with an equimolar amount of at least one compound from the group of sodium hydroxide, potassium hydroxide, sodium carbonate, potassium carbonate, triethanolamine, or other soap-forming neutralizing bases well known in the art. Water, preferably distilled, is used to facilitate the mixing of the fatty acid blend with the base, resulting in more uniform reaction. The water is present in an amount in the range of about 5% to about 30% by weight of the reactants, preferably in the range of about 22% to about 30% by weight.

After neutralization, the soap is cooled and then dried to a lower moisture level to permit refining, plodding and stamping through soap finishing equipment well known in the art, such as that manufactured by Mazzoni s.P.A. Typically, the soap is dried to a moisture level of about 10% to about 14% by weight, with the soap bar after finishing having a moisture level in the range of 8% to 12%.

When broken down by chain length, the soap bar is based on a neutralized blend of about 70% to about 85% by weight $C_{16}$ to $C_{18}$ fatty acids, about 13% to about 25% by weight $C_{12}$ to $C_{15}$ fatty acids, and about 2% to about 5% by weight pelargonic acid. Neutralization is accomplished by the use of at least one of the following bases from the group of sodium hydroxide, potassium hydroxide, sodium carbonate, potassium carbonate, and triethanolamine. Sufficient water is present in the soap to permit formation and retention of a bar shape. Preferably, the blend contains about 78% to about 83% by weight $C_{16}$ to $C_{18}$ fatty acids, about 14% to about 18% by weight $C_{12}$ to $C_{15}$ fatty acids and about 2% to about 4% by weight pelargonic acid. The neutralizing base is preferably sodium hydroxide, potassium hydroxide, or a mixture thereof. The preferred water concentration is in the range of about 7% to about 14% by weight.

OPERATING EXAMPLES

The following detailed operating examples illustrate the practice of the invention in its most preferred form, thereby enabling a person of ordinary skill in the art to practice the invention. The principles of this invention, its operating parameters and other obvious modifications thereof will be understood in view of the following detailed procedure.

Plodded soap bars were prepared by neutralizing tallow/coco fatty acid blends with and without added pelargonic acid with 98% active sodium hydroxide. A tallow/coco fatty acid blend was employed as a reference and is typical of prior art compositions. The pH values of the soaps upon neutralization were in the range of 9.0 to 9.5. Distilled water was employed in all neutralization runs.

Below is a table listing the weight percentages of the various fatty acid blends used in preparing soap bars and the composition of the blends by chain length.

TABLE 3

| SOAP BAR FATTY ACID BLENDS | | | | |
|---|---|---|---|---|
| | Soap Bar: | | | |
| | #1 | #2 | #3 | #4 |
| | Fatty Acid Blend*: | | | |
| Chain Length: (weight %) | 80/20 Tallow/ Coco (E-401[1]/ E-626[2]) | 80/20 Tallow/ Stripped Coco (E-401/ E-627[3]) | 80/16.6/3.4 Tallow/ Stripped Coco/ Pelargonic (E-401/E-627/E-1202[4]) | 80/16.6/3.4 Tallow/ Stripped Coco/Short Chain Mix (E-401/E-627/E-658[5]) |
| $C_6$ | 0.1 | — | — | 0.1 |
| $C_8$ | 2.0 | — | 0.1 | 1.9 |
| $C_9$ | — | — | 3.2 | — |
| $C_{10}$ | 1.4 | 0.1 | 0.2 | 1.5 |
| $C_{12}$ | 9.7 | 11.1 | 9.2 | 9.2 |
| $C_{14}$ | 5.4 | 6.3 | 5.6 | 5.6 |
| $C_{15}$ | 0.4 | 0.4 | 0.4 | 0.4 |
| $C_{16}$ | 23.3 | 23.8 | 23.4 | 23.4 |
| $C_{16:1}$ | 3.2 | 3.2 | 3.2 | 3.2 |
| $C_{17}$ | 0.7 | 0.8 | 0.8 | 0.8 |
| $C_{18}$ | 15.0 | 15.8 | 15.4 | 15.4 |
| $C_{18:1}$ | 33.7 | 33.7 | 33.7 | 33.7 |
| $C_{18:2}$ | 4.2 | 4.0 | 4.0 | 4.0 |
| $C_{18:3}$ | 0.8 | 0.8 | 0.8 | 0.8 |
| Others | 0.1 | — | — | — |

[1]Emery ® 401 Tallow Fatty Acid, Quantum Chemical Corp., Emery Division
[2]Emery ® 626 Low IV Ultra Coconut Fatty Acid, Quantum Chemical Corp., Emery Division
[3]Emery ® 627 Low IV, Stripped, Ultra Coconut Fatty Acid, Quantum Chemical Corp., Emery Division
[4]Emery ® 1202 Pelargonic Acid, Quantum Chemical Corp., Emery Division
[5]Emery ® 658 Caprylic-Capric Acid, Quantum Chemical Corp., Emery Division
*Actual gas chromatographic analyses were performed on E-626 and E-627 to determine the exact amount of short-chain acids which needed to be readded to permit valid comparison. The compositions of the remaining acids were based on specification data.

Approximately 1500 g of the fatty acid blend was charged into a stainless steel 4 qt. Hobart mixer bowl. The blend was then melted over a conventional steam table at a temperature of about 65°±5° C. and agitated thoroughly. An amount of 98% active NaOH such as that supplied by EM Science equimolar to that of the individual fatty acid blend, as determined by acid value calculation, was then weighed and dissolved in distilled water. Typically, about 235 g±10 g NaOH was used for each reaction. The amount of distilled water was sufficient to produce a neutralized soap having about 30% moisture. Typically, for a 1500g charge of fatty acid, about 600 g of distilled water was used.

The sodium hydroxide solution was cooled to about room temperature, 30°±5° C. When the fatty acid blend and sodium hydroxide solution were within the proper temperature range, the fatty acid blend was agitated in the Hobart mixer by means of a paddle-type blade. The sodium hydroxide solution was added slowly to the fatty acid blend with continued agitation. After the alkaline solution had been added, agitation continued for several minutes to ensure thorough mixing and complete neutralization. The viscous molten soap was then poured into a glass or plastic pan and permitted to air dry until the moisture level decreased to about 10% to about 14%.

After drying, the neutralized soap was placed into the hopper of a lab-scale Mazzoni 100 Refiner-Plodder which is of conventional design and which approximates the operation of commercial scale equipment. The soap was forced two times each through a series of three increasingly fine screens, passed through a reduced diameter heated extruder head to form logs of soap, and stamped to form a bar.

The finished bars were evaluated for lathering properties by a panel of six panelists. The bars were evaluated for the speed with which foam could be generated, otherwise known as the flash foam; the lather volume; and the richness and creaminess of the lather generated. Each panelist washed his/her hands in moderately hard tap water in the same manner as one would use a soap bar for cleansing of the hands.

Each panelist then evaluated each of these characteristics for each bar and awarded a numerical ranking on a scale of 1 to 5 for each characteristic, with a ranking of 5 being the most favorable ranking, and the ranking of 4, 3, 2 and 1 being considered less favorable in that order of ranking. The compilation of the panelists' rankings for each of the test characteristics for each bar are provided below as simple arithmetical averages of each set of the rankings from the panel. The averages of the evaluation results for each bar are given below.

TABLE 4

| | Soap Bar: | | | | | | |
|---|---|---|---|---|---|---|---|
| | #1 | | #2 | | #3 | | #4 |
| | Fresh | Aged | Fresh | Aged | Fresh | Aged | Fresh |
| Average Flash Foam: | 2.5 | 3.0 | 2.5 | 3.3 | 3.3 | 3.3 | 3.0 |
| Average Lather Volume: | 2.7 | 3.0 | 2.5 | 2.7 | 3.3 | 3.3 | 2.8 |
| Average Lather Richness/Creaminess: | 3.3 | 3.2 | 2.8 | 3.3 | 3.5 | 4.0 | 3.0 |

Bars #1, #2 and #3 were prepared at about the same time and were evaluated shortly thereafter. The average results for this first comparison are listed under the subheadings "Fresh". Later, soap bar #4 was prepared. Bar #4 contains stripped coconut fatty acid with the stripped acids added back in the same procedure as used in preparing bar #3 with back-added pelargonic acid. Bar #4 thus has approximately the same fatty acid composition as bar #1, albeit after stripping and re-addition operations. Improved results from bar #4 relative to bar #1 could indicate that the coconut acid stripping operation removed some heretofore unknown lather-inhibiting component which would need to be taken into consideration in evaluating all bars containing stripped coconut fatty acid. A second panel evaluation was conducted on the now-aged bars #1, #2 and #3 and fresh bar #4. The latest evaluation results for bars #1, #2 and #3 are listed under the subheadings "Aged".

As Table 4 demonstrates, a comparison of the three "fresh" bars Nos. 1, 2 and 3 shows the marked improvement in flash foam, lather volume and creaminess properties of bar #3 over bars #1 and #2. This improvement is due either to the replacement of the short chain stripped fatty acids from coconut fatty acid with pelargonic acid, or to the operation of stripping short-chain acids which removed some unknown lather-inhibiting agent. Subsequent comparison of "aged" bars Nos. 1, 2 and 3 with "fresh" bar #4 establish that the stripping operation alone with subsequent back-addition of the stripped acid does not result in the improvement demonstrated in the bar containing the pelargonic acid. It is thus the addition of the odd chain length pelargonic acid which results in an unexpected improvement in lathering properties over a similar weight percentage of $C_6$, $C_8$ and $C_{10}$ component fatty acids.

Having described this invention and its operating parameters, variations may be achieved without departing from the spirit and scope thereof.

What is claimed is:

1. A soap bar composition for preparing a refined and plodded soap bar comprising:

a neutralizable blend of about 68% to about 84% by weight tallow fatty acid, about 28% to about 14% by weight coconut-type fatty acid, and about 2% to about 5% by weight pelargonic acid;

a neutralizing amount of a base selected from the group consisting of sodium hydroxide, potassium hydroxide, triethanolamine, and mixtures thereof; and about 5% to about 30% by weight water intimately mixed with said blend and said base.

2. The soap bar composition of claim 1 wherein said neutralizable blend is comprised of about 78% to about 83% by weight tallow fatty acid, about 20% to about 15% by weight coconut-type fatty acid, and about 2% to about 4% by weight pelargonic acid.

3. A process for the production of a fatty acid blend for use in manufacturing soap bars comprising:

stripping from a coconut-type fatty acid an amount of component fatty acids in the range of about $C_6$ to about $C_{10}$;

measuring an amount of pelargonic acid about equal in weight to said amount of said stripped fatty acid components; and combining said stripped coconut-type fatty acid and said amount of pelargonic acid with a tallow fatty acid to produce a homogeneous blend.

4. The process of claim 3 wherein said homogeneous blend contains about 68% to about 84% by weight said tallow fatty acid, about 28% to about 14% by weight said stripped coconut-type fatty acid, and about 2% to about 5% by weight said pelargonic acid.

5. A soap bar prepared by refining and plodding a soap bar composition comprising:

a base neutralized salt of a fatty acid blend having from about 70% to abotu 85% by weight $C_{16}$ to $C_{18}$ fatty acids, about 13% to about 25% by weight $C_{12}$ to $C_{15}$ fatty acids, and about 2% to about 5% by weight pelargonic acid; and water in sufficient concentration to maintain the soap bar in a bar shape.

6. The soap bar of claim 5 wherein said base is selected from the group consisting of sodium hydroxide, potassium hydroxide, sodium carbonate, potassium carbonate, triethanolamine, and mixtures thereof.

7. The soap bar of claim 5 wherein said fatty acid blend contains from about 78% to about 83% by weight said $C_{16}$ to $C_{18}$ fatty acids, about 14% to about 18% by weight said $C_{12}$ to $C_{15}$ fatty acids and about 2% to about 4% by weight said pelargonic acid.

8. The soap bar of claim 5 wherein said water concentration is in the range of about 7% to about 14% by weight.

9. A method of improving the lathering properties of a plodded soap bar produced form a neutralized blend of tallow and coconut fatty acids comprising:

removing essentially all saturated fatty acids of six, eight and ten carbon atoms from said tallow and said coconut fatty acids; and adding to said tallow and said coconut fatty acids an amount of pelargonic acid having a weight approximately equal to said removed saturated fatty acids of six, eight and ten carbon atoms.

* * * * *